United States Patent [19]

Kriegner et al.

[11] Patent Number: 4,676,297

[45] Date of Patent: Jun. 30, 1987

[54] STRAND GUIDE ARRANGEMENT TO BE USED IN A CONTINUOUS CASTING PLANT

[75] Inventors: Othmar Kriegner, St. Valentin; Franz Lang, Linz, both of Austria

[73] Assignee: Voest-Alpine, Linz, Austria

[21] Appl. No.: 797,606

[22] Filed: Nov. 13, 1985

[30] Foreign Application Priority Data

Nov. 29, 1984 [AT] Austria ..... 3784/84

[51] Int. Cl.[4] ..... B22D 11/12

[52] U.S. Cl. ..... 164/442; 164/444

[58] Field of Search ..... 164/442, 448, 486, 444

[56] References Cited

U.S. PATENT DOCUMENTS 3,536,127 10/1970 Tofel ..... 164/442
3,965,974 6/1976 Sernetz et al. ..... 164/448
4,137,963 2/1979 Langer et al. ..... 164/442

FOREIGN PATENT DOCUMENTS 1105567 4/1961 Fed. Rep. of Germany ..... 164/442
2454902 11/1974 Fed. Rep. of Germany ..... 164/448
2552418 6/1977 Fed. Rep. of Germany ..... 164/448

*Primary Examiner*—Nicholas P. Godici
*Assistant Examiner*—Karen Skillman
*Attorney, Agent, or Firm*—Handal & Morofsky

[57] ABSTRACT

A strand guide for a continuous casting plant includes rollers supporting and guiding the strand. Each roller has a cavity through which a coolant flows and which is connected with a coolant supply duct and a coolant discharge duct. The coolant discharge duct is aligned in duct-like manner with at least one tuyere or a set of tuyeres of an external cooling device. In order to combine the advantages of an external cooling device with the advantages of an internal cooling of the rollers, the external cooling device includes tuyeres or sets of tuyeres arranged between the rollers. Each tuyere or set of tuyeres is arranged adjacent the roller end that includes the coolant discharge duct. The jet direction of the tuyere or tuyeres of the set of tuyeres is directed opposite to the flow direction of the coolant through the roller.

5 Claims, 4 Drawing Figures

STRAND GUIDE ARRANGEMENT TO BE USED IN A CONTINUOUS CASTING PLANT

The invention relates to a strand guide for a continuous casting plant, in particular a continuous casting plant for casting steel strands having slab cross section, comprising rollers supporting and guiding the strand, each of which has a cavity through which a coolant flows and which is connected with a coolant supply duct and a coolant discharge duct, the coolant discharge duct being aligned in duct-like manner with at least one tuyere or a set of tuyeres of an external cooling means.

From U.S. Pat. No. 3,766,968 a strand guide is known, which comprises an external cooling means formed by flat jet tuyeres arranged parallel to the surface of the strand and at a distance thereof. These tuyeres effect cooling of the roller surfaces facing the strand surface and washing off of the scales incurring on the strand surface as well as, if necessary, cooling of the strand surface itself.

From German Offenlegungsschrift No. 25 52 969, it is known to provide the strand supporting and guiding rollers with an internal cooling for the purpose of balancing out temperature differences between axles, bearings and roller jackets, which internal cooling is to be operated independently of an external cooling designed as a splash cooler.

With modern high-output continuous casting plants, in particular with fast continuous casting plants, a particularly effective cooling of the plant parts and also of the strand is necessary. Thus, there has been the tendency to provide both an external cooling means and an internal cooling for the rollers supporting and guiding the strand. The combination of an external cooling means and an internal cooling of the roller involves enormous structural expenditures due to the required pipework. Furthermore, complex controlling means must be provided in addition to independent measuring and controlling apparatus for the automatic control of the two cooling means, in order to prevent the two automatic controls from influencing each other.

From Austrian Pat. No. 183,879 a strand guide of the initially defined kind is known, whose coolant discharge ducts are connected with tuyeres arranged on the front sides of the rollers and spraying the coolant into a space provided in the extension of the roller axles. The purpose of this Austrian patent is to prevent the return of the coolant to the shaft end at which it enters.

The invention aims at avoiding these disadvantages and difficulties and has as its object to provide a strand guide of the initially defined kind, with which the advantages of an external cooling means are combined with the advantages of an internal cooling of the rollers, without the disadvantages involved therewith. In particular is the strand guide to be designed in a most simplified manner, both in terms of structure and in terms of control engineering.

This object is achieved according to the invention in that the external cooling means comprises tuyeres or sets of tuyeres arranged between the rollers and that each tuyere or set of tuyeres is arranged adjacent the roller end that includes the coolant discharge duct, the jet directions(s) of the tuyere or tuyeres of the set of tuyeres being directed opposite to the flow direction of the coolant through the roller. The combination of external cooling means with internal roller cooling not only results in considerable savings in pipework, but also has the advantage that a single measuring and control loop will suffice.

To cool rollers disposed on the arc outer side of an arcuate strand guide, the coolant discharge duct of a roller suitably is connected with two tuyeres or sets of tuyeres, one of which (sets of) tuyeres is arranged in front of the roller and one of which (sets of) tuyeres is arranged behind the roller, seen in the strand extraction direction. A strand guide of this type effects good cooling of the plant parts to be cooled and, if desired, also of the strand surface, despite the flow-off of coolant by means of gravity.

For a most uniform cooling of the strand surface by means of the cooled rollers and of the external cooling means, the coolant supply ducts of neighboring rollers advantageously are arranged on opposite sides of the strand guide, the coolant discharge ducts being provided on the respective opposite ends of the rollers.

The invention will now be explained in more detail by way of various embodiments and with reference to the accompanying drawings, wherein.

Figure 1:
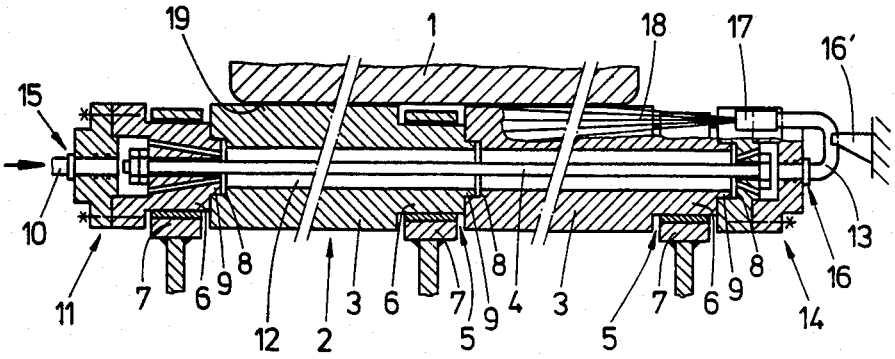
FIG. 1 is a section through a strand guide according to the invention.

A continuously cast slab 1 rests on a roller 2, its shell being supported by the roller. The roller 2 is comprised of equal interchangeable roller bodies 3 held together by a clamping anchor 4. Each of the roller bodies 3 is offset on one end 5 so as to form a bearing neck 6 supported on a bearing 7. The mutual centering of the roller bodies 3 is ensured by a central recess 8 on one front side and a projection 9 that fits into this recess on the opposite front side, of the roller body 3.

The internal cooling of the rollers 2 is effected by the supply of coolant via a coolant supply duct 10 on one end 11 of each roller 2, into a cavity 12 surrounding the clamping anchor 4, from where it is discharged via a coolant discharge duct 13 on the opposite end 14 of the roller. The connection of the coolant supply duct 10, and of the coolant discharge duct 13, with the roller 2 is realized by means of one rotary connection 15, 16 each.

The coolant discharge duct 13 is deflected by 180° immediately beside the roller end 14 such that its end provided with at least one tuyere 17 is directed parallel to the axis of the roller 2 in the direction towards the opposite roller end 11. The coolant jet 18 emerging from the tuyere 17, thus, is used for the external cooling of the rollers 2 and for the cooling of the strand surface 19 contacting the rollers 2.

In order to prevent the coolant discharge duct 13 from turning with the roller 2, a console 16' supporting the coolant discharge duct 13 is fastened to a stationary stand part of the continuous casting plant.

Figure 2:
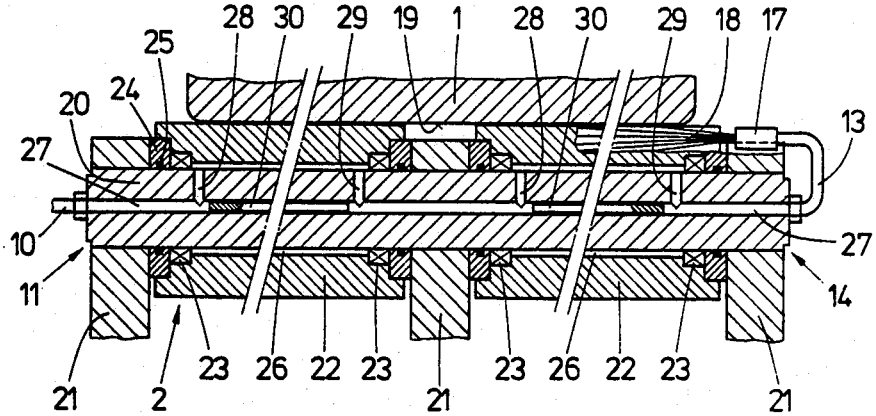
FIG. 2 shows a further exemplary embodiment of a strand guide in an illustration analogous to FIG. 1.

According to the embodiment of FIG. 2, a roller axle 20 is fastened in the supporting structure (not illustrated) via axle holders 21. Between two neighboring axle holders 21, a cylindrical roller body 22 is each arranged, which is mounted on the roller axle 20, on its ends, by means of bearings 23. The roller bodies, towards outside, are sealed by closing discs 24 in which packing rings 25 are inserted. The inner diameters of the roller bodies 22 are kept larger than the outer diameter of the roller axle 20 to form an annular cavity 26. The roller axle is penetrated by an axial bore 27 that is in connection with the annular cavity 26 via radial bores 28, 29.

Coolant is conducted into the axial bore 27 via a coolant supply duct 10 on one end 11 of the roller 2. In order to return the coolant into the annular cavity 26 via the radial bore 28 and from there into the axial bore 27 via the radial bore 29, the axial bore 27 is closed by a pin 30 between the radial bores 28, 29 in the region of the cavities 26. This meander-like deflection is provided with each consecutive roller body 22. The bearings 23 are sealed relative to the cavity 26.

On the other end 14 of the roller 2, the coolant gets into the coolant discharge duct 13 via the axial bore 27. Even with this embodiment, the end of the coolant discharge duct 13 is deflected by 180° immediately beside the roller end 14, into the direction towards the opposite roller end 11, and is provided with a tuyere 17, through which the coolant emerges in the form of a coolant jet 18. With this embodiment, it is not necessary to support the coolant discharge duct 13 on a stand part of the continuous casting plant, because it is fastened to the irrotationally supported roller axle 20.

Figure 3:
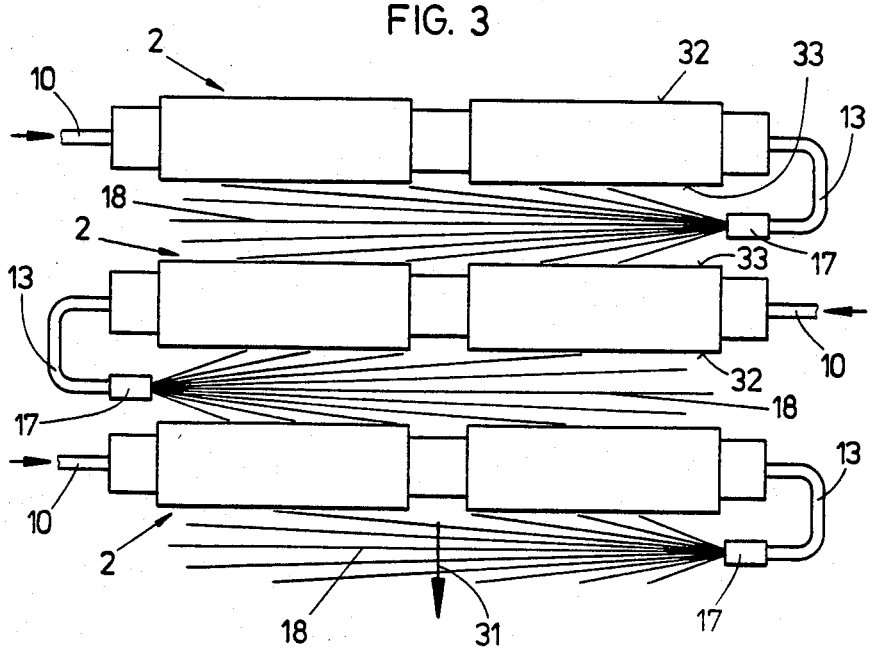
FIGS. 3 and 4 are views of the inner arc and of the outer arc, respectively, of a strand guide, in the radial direction.

In FIG. 3, the disposition of the tuyeres 17 alternately on opposite ends of neighboring rollers 2 is illustrated, with all the tuyeres 17 being arranged behind the pertaining rollers 2, seen in the strand extraction direction 31. From this arrangement, a coolant jet 18 results between neighboring rollers 2, that emerges on opposite ends of the rollers 2 with consecutive tuyeres 17. Thereby, the collant jet 18 sweeps over each roller in one direction on one jacket side 32 and in the opposite direction on the other jacket side 33, and over the strand surface 19 alternately from opposite sides. This arrangement is particularly suited to cool the rollers 2 of the inner arc of the strand guide.

Figure 4:
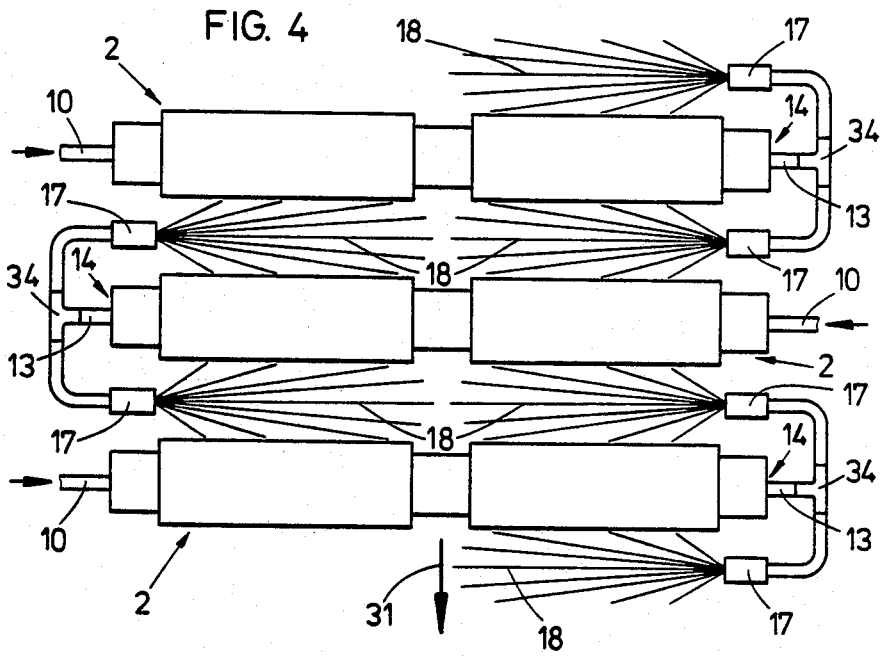

In order to counteract the rapid flow-off of coolant on the ouer arc of the strand guide, a T-piece 34 is inserted in each coolant discharge duct 13 immediately above the roller end 14, according to FIG. 4, so that two ducts, which are each deflected by 180° and carry tuyeres 17, are connected to the coolant discharge duct 13 of each roller 2, one tuyere 17 each being arranged in front of and one being arranged behind, the pertaining roller 2, seen in the stand extraction direction 31.

On account of the coolant discharge ducts 13 provided on opposite ends of neighboring rollers 2, two oppositely directed coolant jets 18 are generated between neighboring rollers 2, which meet the coolant demand, which is larger on the outer arc of the strand guide due to the rapid flow-off of coolant there.

The invention is not limited to the exemplary embodiment illustrated, but may be modified in various aspects. Thus, it is possible to guide the coolant within the roller such that the coolant supply duct and the coolant discharge duct and hence the tuyeres for the external cooling of the roller are on the same end of the roller. Instead of the individual tuyeres 17, sets of tuyeres may be provided—in particular with larger roller axis distances.

What we claim is:

1. In a strand guide arrangement to be used in a continuous casting plant, such as a continuous casting plant for casting steel strands having a slab cross section, and of the type including a plurality of rollers supporting and guiding said strand, each of said rollers including a cavity for carrying a coolant flow therethrough, a first end provided with a coolant supply duct and a second end provided with a coolant discharge duct said coolant supply and discharge ducts communicating with said cavity, and at least one external cooling means which is aligned in a duct-like manner with said coolant discharge duct, the improvement wherein said external cooling means comprises at least one tuyere means arranged between said rollers, each tuyere means being arranged so as to be adjacent said second end of its respective roller and connected to and receiving coolant from its respective coolant discharge duct and adapted to emit a jet in a direction opposite the direction of said coolant flow through its respective roller.

2. A strand guide arrangement as set forth in claim 1, wherein the coolant supply ducts of neighboring rollers are arranged on opposite sides of said strand guide and the coolant discharge ducts of said neighboring rollers are provided on the respective opposite ends of said rollers.

3. A strand guide arrangement as set forth in claims 1, wherein said tuyere means comprises a pair of tuyeres.

4. In a strand guide arrangement to be used in a continuous casting plant, such as a continuous casting plant for casting steel strands having a slab cross section, and of the type including a plurality of rollers supporting and guiding said strand, each of said rollers including a cavity for carrying a coolant flow therethrough, a first end provided with a coolant supply duct and a second end provided with a coolant discharge duct said coolant supply and discharge ducts communicating with said cavity, and at least one external cooling means which is aligned in a duct-like manner with said coolant discharge duct, the improvement wherein said external cooling means comprises at least one tuyere means arranged between said rollers, each tuyere means being arranged so as to be adjacent said second end of its respective roller including its respective coolant discharge duct and adapted to emit a jet in a direction opposite the direction of said coolant flow through its respective roller, wherein two tuyere means are connected to and receives coolant from duct the coolant discharge of a roller of said plurality of rollers, one of said two tuyere means being arranged in front of said roller as seen in the strand extraction direction, and the other of said two tuyere means being arranged behind said roller, as seen in the strand extraction direction.

5. In a strand guide arrangement to be used in a continuous casting plant, such as a continuous casting plant for casting steel strands having a slab cross section, and of the type including a plurality of rollers supporting and guiding said strand, each of said rollers including a cavity for carrying a coolant flow therethrough, a first end provided with a coolant supply duct and a second end provided with a coolant discharge duct said coolant supply and discharge ducts communicating with said cavity, and at least one external cooling means which is aligned in a duct-like manner with said coolant discharge duct, the improvement wherein said external cooling means comprises at least one tuyere means arranged between said rollers, each tuyere means being arranged so as to be adjacent said second end of its respective roller including its respective coolant discharge duct and adapted to emit a jet in a direction opposite the direction of said coolant flow through its respective roller, wherein said tuyere means comprises a tuyere.

* * * * *